US011112198B2

(12) United States Patent
Lewis et al.

(10) Patent No.: US 11,112,198 B2
(45) Date of Patent: Sep. 7, 2021

(54) EXTRACTION PRESS ASSEMBLY FOR USE WITH BORED STRUCTURES

(71) Applicant: Raytheon Company, Waltham, MA (US)

(72) Inventors: Parker Lewis, Benson, AZ (US); Douglas J. Eliason, St. David, AZ (US); Mark A. Scott, Vail, AZ (US)

(73) Assignee: Raytheon Company, Waltham, MA (US)

( * ) Notice: Subject to any disclaimer, the term of this patent is extended or adjusted under 35 U.S.C. 154(b) by 31 days.

(21) Appl. No.: 16/739,062

(22) Filed: Jan. 9, 2020

(65) Prior Publication Data

US 2021/0215448 A1 Jul. 15, 2021

(51) Int. Cl.
*F41A 15/22* (2006.01)
*F41A 15/08* (2006.01)

(52) U.S. Cl.
CPC ..... *F41A 15/22* (2013.01); *F41A 15/08* (2013.01)

(58) Field of Classification Search
CPC ..... F41A 15/08; F41A 15/20; F41A 15/22
USPC ..... 81/3.05
See application file for complete search history.

(56) References Cited

U.S. PATENT DOCUMENTS 543,652 A * 7/1895 Palm ..... F41A 15/22 81/3.05
1,665,988 A 4/1928 Smith
3,716,884 A 2/1973 Lavins
3,731,587 A 5/1973 Digiacomo
3,750,262 A 8/1973 Taylor, III
4,586,844 A 5/1986 Hammonds et al.
4,597,472 A 7/1986 Hjelm
5,836,099 A 11/1998 Pace et al.
7,861,639 B1 1/2011 Trybulski et al.
2010/0008715 A1 1/2010 Minowa et al.
2012/0132549 A1 5/2012 Dewey
2015/0176939 A1 6/2015 Thalmann et al.
(Continued)

FOREIGN PATENT DOCUMENTS

FR 2975178 B1 4/2013
GB 734641 A 8/1955
(Continued)

*Primary Examiner* — Bret Hayes

(57) ABSTRACT

Disclosed is an extraction press assembly for facilitating removal of an object from a bore of a structure. The extraction press assembly comprises a coupling mount, a base plate, a support structure, and a press. The coupling mount can be configured to couple to the structure, thus securing the extraction press assembly to the structure. The base plate can be axially spaced from the coupling mount, and can support the press. The support structure can comprise axial extensions coupling the coupling mount to the base plate, and facilitating adjustment of the base plate (and thus the press) relative to the coupling mount. The press can be located between the coupling mount and the base plate and can be configured to expand and contract axially, and to exert a pressing force upon an extraction pole of an extraction pole assembly within the bore, which force is transferred to the object lodged within the bore. The press can be pivotally coupled to the base plate to rotate between a first position for extracting an object and a second position for accessing the bore.

21 Claims, 9 Drawing Sheets

(56) References Cited

U.S. PATENT DOCUMENTS

| | | | | |
|---|---|---|---|---|
| 2017/0363399 | A1* | 12/2017 | Berger | F42B 35/02 |
| 2020/0018080 | A1 | 1/2020 | Steck et al. | |

FOREIGN PATENT DOCUMENTS

| | | | |
|---|---|---|---|
| RU | 2254538 | C1 | 6/2005 |
| RU | 2003136237 | A | 7/2005 |

* cited by examiner

EXTRACTION PRESS ASSEMBLY FOR USE WITH BORED STRUCTURES

BACKGROUND

Field testing of large bore weapons, such as large Howitzers, can require projectiles to be loaded and unloaded repeatedly. Projectiles can be designed to fit snuggly within the bore of a barrel when loaded to prevent the projectile from falling back within the bore before firing. Artillery projectiles, such as "guided" projectiles comprising complex guidance systems, are becoming increasingly sophisticated and expensive. In view of the high cost of a projectile, it is increasingly important to not damage any projectiles when field testing them and removing them from the barrel.

Various methods have been used in the past to remove projectiles from the barrel. Prior methods have included dropping a weight down an inclined barrel to dislodge the projectile, inserting a push rod in the barrel and hitting the push rod with a hammer to dislodge the projectile, and using a hydraulic ram to push a rod down the barrel. While the previous attempts were typically successful in removing the projectile from the barrel, they may not be suitable for field testing where certain information is intended to be gathered or obtained. For example, one type of field test measures the force required to remove the projectile from the barrel. The impact of a weight or a hammer may not be suitable for use with a sensor that is used to measure a force required for extracting the projectile. Additionally, hydraulic ram systems may require maintenance or access to electricity for operation. Use of such systems can present a logistical issue, such as in remote or other locations where access to a power source is not readily available. Furthermore, heavy parts, such as hydraulic ram pistons, can be a nuisance as they are installed, uninstalled, and reinstalled multiple times during testing and data collection.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
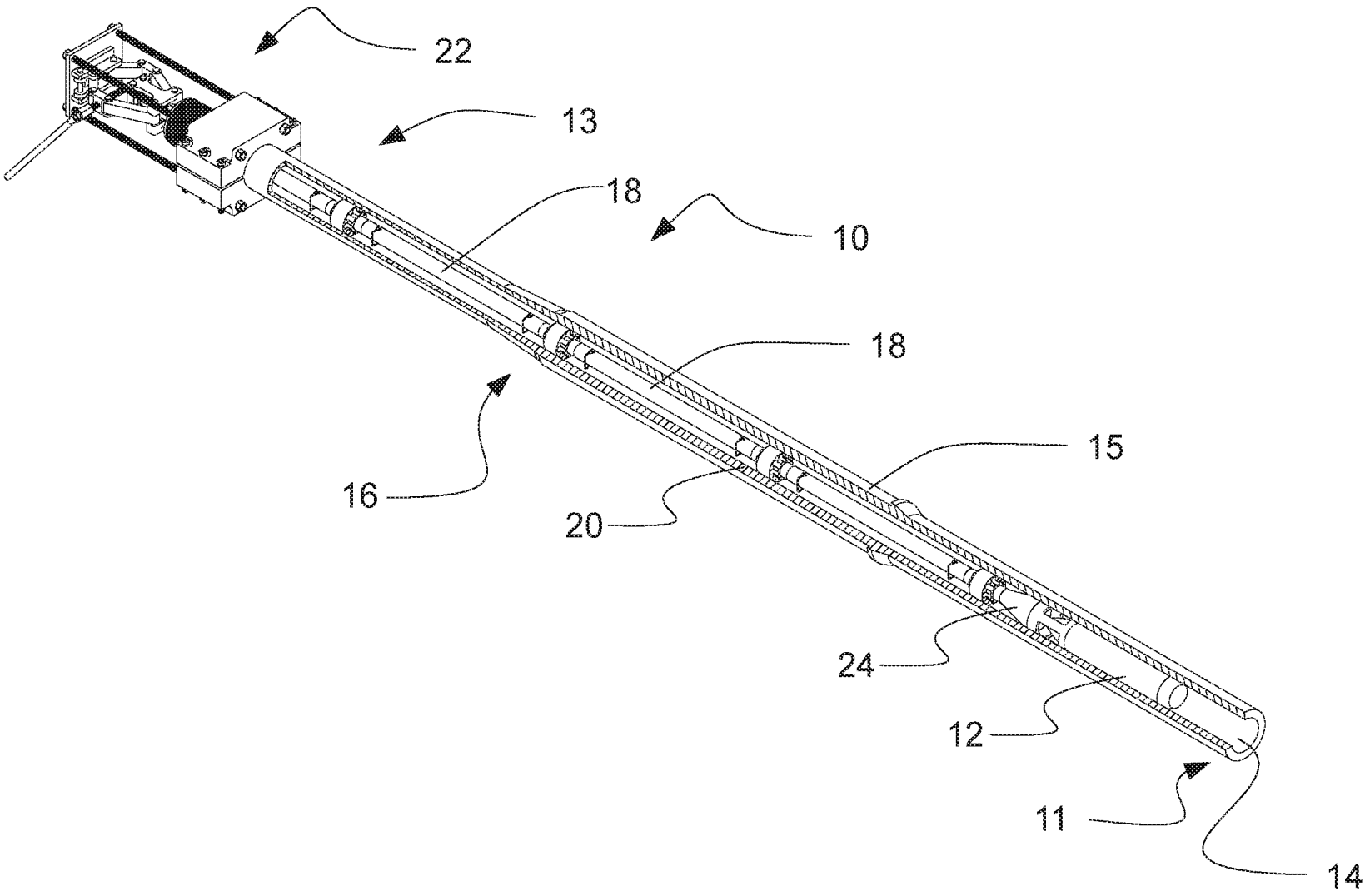
FIG. 1 illustrates an isometric view of an extraction system in the form of a projectile extraction system in use with a barrel of a weapon to extract a projectile, wherein the projectile extraction system comprises an extraction press assembly and an extraction pole assembly operable for use with the extraction press assembly, in accordance with an example of the present disclosure.

Reference will now be made to the examples illustrated, and specific language will be used herein to describe the same. It will nevertheless be understood that no limitation of the scope of the invention is thereby intended.

DETAILED DESCRIPTION

As used herein, the term "distal" refers to a direction or orientation distant from a point of reference. For example, referring to an extraction system, a base can be used as a point of reference. Thus, a direction away from the base can be considered a distal direction. Similarly, an object or reference that is further away from the base than another object or reference can be considered distal.

As used herein, the term "proximal" refers to a direction or orientation towards a point of reference. For example, referring to an extraction system, a base can be used as a point of reference. Thus, a direction towards the base can be considered a proximal direction. Similarly, an object or reference that is closer to the base than another object or reference can be considered proximal.

An initial overview of the inventive concepts is provided below, and then specific examples are described in further detail later. This initial summary is intended to aid readers in understanding the examples more quickly but is not intended to identify key features or essential features of the examples, nor is it intended to limit the scope of the claimed subject matter.

In one example, disclosed is an extraction press assembly for facilitating removal of an object from a bore of a structure. The extraction press assembly comprises a coupling mount, a base plate, a support structure, and a press. The coupling mount is configured to couple to a structure having a bore. The base plate is axially spaced from the coupling mount and the support structure has axial extensions operable to couple the coupling mount to the base plate. The press is supported between the coupling mount and the base plate and is configured to expand and contract axially to exert a pressing force on an extraction pole within the bore. The press is pivotally secured to the base plate, such that the press is rotatable between a first position that axially aligns the press interface with the axis of the bore to facilitate extracting of an object from the bore, and a second position that positions the press interface out of axial alignment with the axis of the bore to facilitate access to the bore.

In accordance with a more detailed aspect, the press can comprise a press base, first and second proximal link arms rotatably coupled to the press base, first and second actuator links rotatably coupled to the first and second proximal link arms, first and second distal link arms rotatably coupled to the first and second actuator links, a press interface rotatably coupled to the first and second distal link arms, and an actuator coupling the first and second actuator links and operable to actuate the press to position the press interface between a retracted position and an extended position.

In accordance with a more detailed aspect, the first and second actuator links can each comprise a threaded aperture and the actuator can comprise a rod having a thread threaded in each threaded aperture of the first and second actuator links. A thread of the threaded aperture of the first actuator link can have a thread direction opposite of a thread of the threaded aperture of the second actuator link.

In accordance with a more detailed aspect, the press interface can comprise a cradle defining a press surface located between the first and second distal link arms.

In accordance with a more detailed aspect, the press can further comprise a load cell supported by the cradle about the press surface.

In accordance with a more detailed aspect, the press base can be pivotally coupled to the base plate.

In accordance with a more detailed aspect, the press interface can be pivotally coupled to at least one of the first or second distal link arms by one or more removable pins, such that removal of any one of the one or more removable pins facilitates at least partial separation of the press interface from the first or second distal link arms.

In accordance with a more detailed aspect, the base plate can comprise a central aperture extending through the base plate.

In accordance with a more detailed aspect, the axial extensions facilitate selective adjustment of the coupling mount relative to the base plate.

Also disclosed is an extraction system for facilitating removal of an object from a bore of a structure. The extraction system comprises an extraction press assembly and an extraction pole assembly. The extraction press assembly comprises a coupling mount configured to couple to the structure, a base plate axially spaced from the coupling mount and supporting a press mount, a support structure operable to couple the coupling mount to the base plate (e.g., one or more axial extensions, such as threaded rods), and a press supported between the coupling mount and the base plate and having a press base rotatably coupled to a press mount to pivotally mount the press to the base plate. The extraction pole assembly comprises a plurality of extraction poles that are configured to receive an axial force from the extraction press assembly.

In accordance with a more detailed aspect, the base plate can comprise a plurality of apertures, the coupling mount can comprise a plurality of complementary apertures, and the support structure can comprise a plurality of threaded rods with each threaded rod extending through an aperture of the base plate and a complementary aperture of the coupling mount.

In accordance with a more detailed aspect, the press mount can comprise a plurality of tabs having an aperture and the press mount interface can comprise a mount aperture. The apertures of the tabs and the mount aperture of the press mount interface can be sized to receive a pin to form a hinge joint between the base plate and the press.

In accordance with a more detailed aspect, the extraction press assembly further can further comprise an adapter positioned between the extraction press assembly and a proximal extraction pole of the extraction pole assembly, where the extraction press assembly operates to apply a force indirectly to the proximal extraction pole via the adapter.

In accordance with a more detailed aspect, the extraction press assembly further can further comprise a load cell supported by a cradle about a press surface of the press, wherein the load cell is operable to measure the axial force applied by the press to the extraction pole assembly.

Also disclosed is a method for removing an object from a bore of a structure. The method comprises inserting an extraction pole assembly into the bore of the structure until the extraction pole assembly contacts the object to be removed from the bore, coupling an extraction press assembly to the structure at an opening of the bore, moving a press of the extraction press assembly to position a press surface near the extraction pole assembly, actuating the press to apply a force to the extraction pole assembly to dislodge the object, and rotating the press surface away from the bore to provide access to the extraction pole assembly.

In accordance with a more detailed aspect, the method can further comprise actuating the press to reposition the press surface away from the extraction pole assembly.

In accordance with a more detailed aspect, the method can further comprise assembling the extraction pole assembly by coupling a plurality of extraction poles end to end.

In accordance with a more detailed aspect, moving the press can comprise adjusting an axial support structure connecting the coupling mount to the base plate.

In accordance with a more detailed aspect, the method can further comprise measuring the force applied to the extraction pole assembly.

In accordance with a more detailed aspect, measuring the force can be facilitated by placing a load cell between the press surface and the extraction pole assembly.

In accordance with a more detailed aspect, the structure can comprise a barrel of a weapon and the object to be removed can comprise a projectile.

Figure 2:
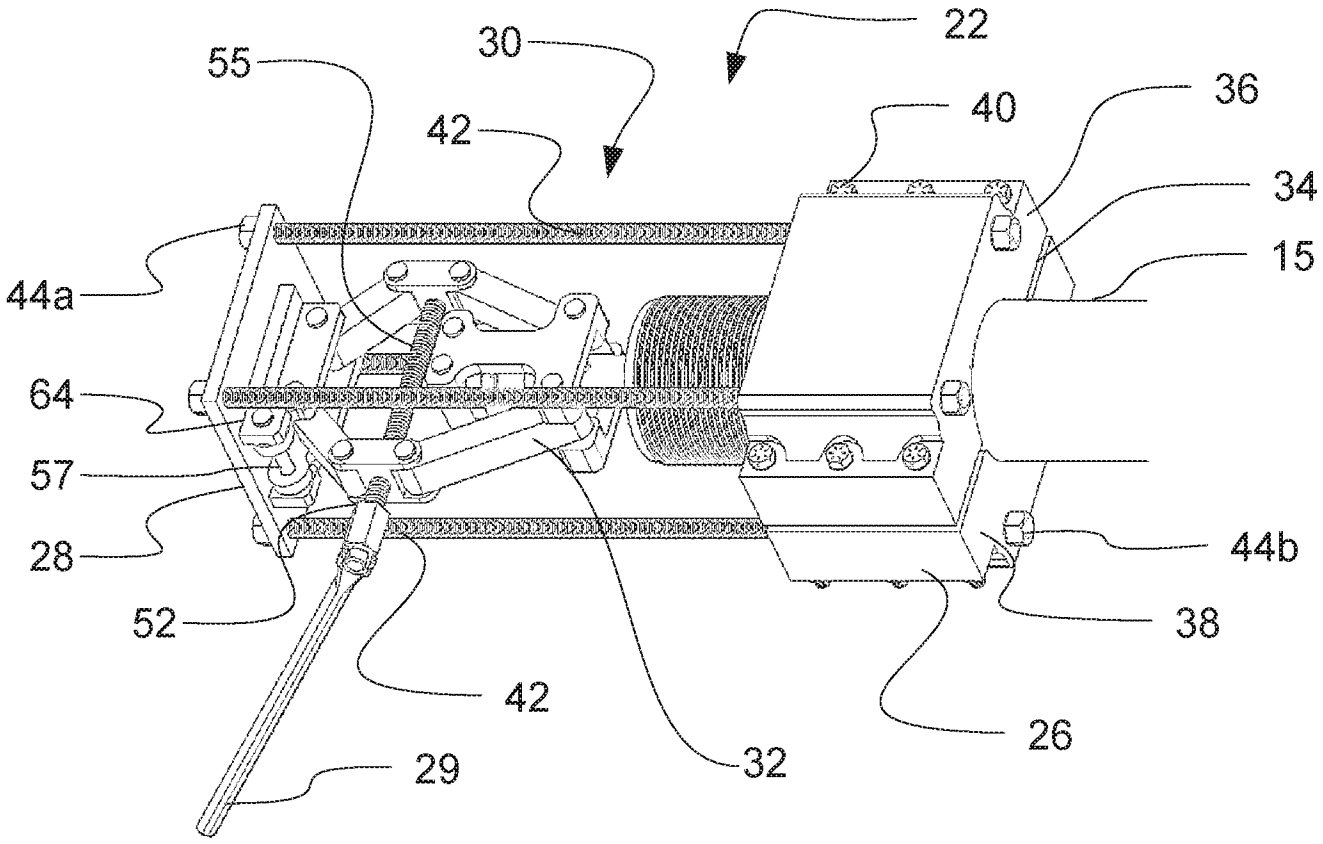
FIG. 2 illustrates the extraction press assembly of the projectile extraction system of FIG. 1.
Figure 3:
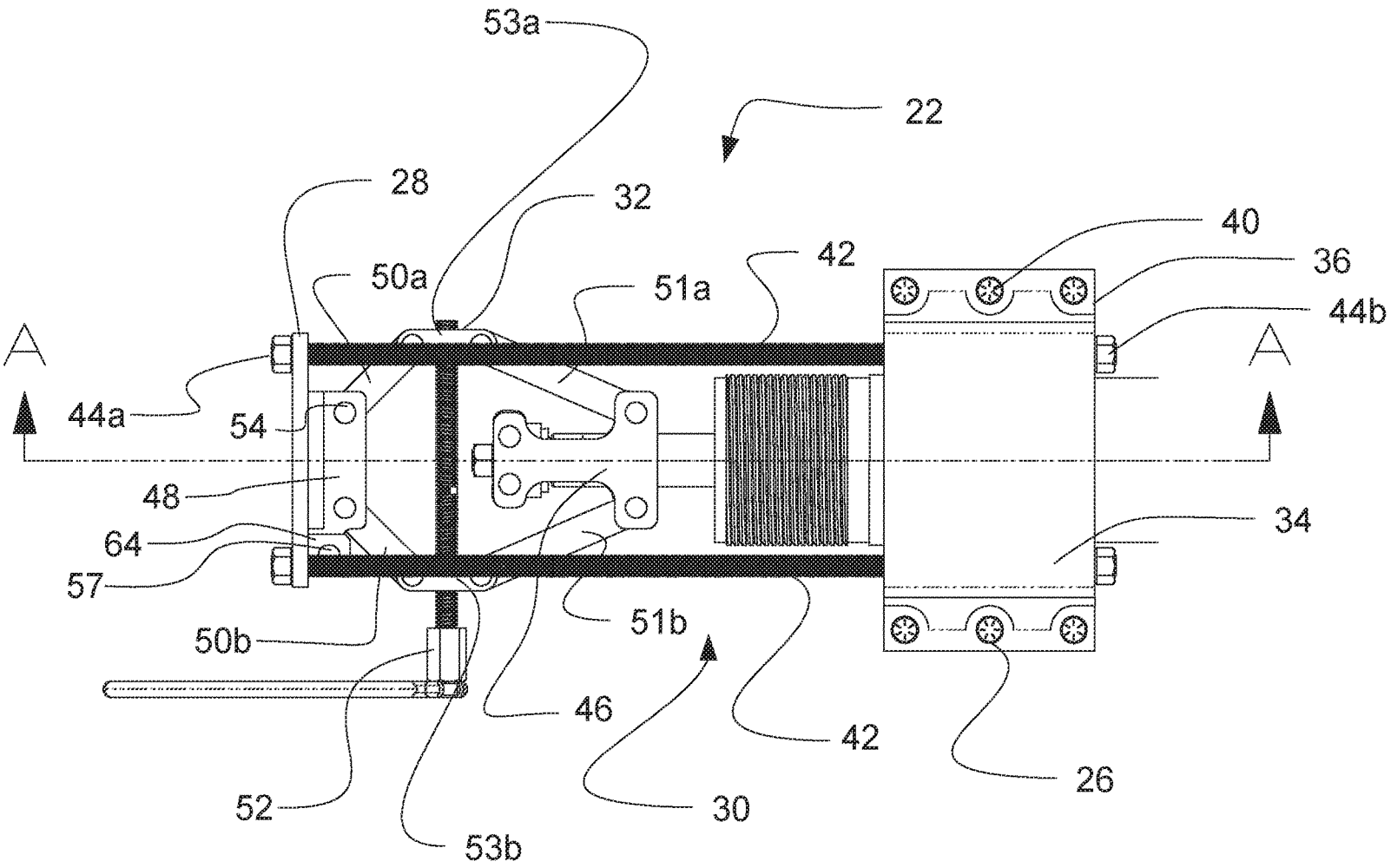
FIG. 3 illustrates a top view of the extraction press assembly of the projectile extraction system of FIG. 1.

To further describe the present technology, examples are now provided with reference to the figures. FIG. 1 illustrates an example of an extraction system for facilitating removal of an object from a bore of a structure. Although the extraction system can be adapted for use to extract different types of objects from different types of bores of different types of structures, the present disclosure will focus on a projectile extraction system 10 for facilitating removal or extraction of a projectile 12 from a bore 14 of a barrel 15 of a projectile firing device or weapon, such as a large bore Howitzer. In the example of FIGS. 1-3, the bore 14 is a bore of a barrel 15 of a 155 mm projectile firing device (e.g., Howitzer, Advanced Gun System (AGS), and others), although the bore 14 can comprise a bore of a barrel of any type and size of projectile firing device (e.g., 105 mm, 152 mm, 175 mm, 203 mm, and other large caliber projectile firing devices, or smaller caliber projectile firing devices).

The projectile extraction system 10 is suitable for use in locations without access to electricity. It can be installed and operated by a single user and allows access to the bore 14 while the projectile extraction system 10 is mounted to the structure.

The bore 14 can have a distal end 11 and a proximal end 13, which is illustrated with a broken-out portion for clarity. The projectile extraction system 10 can comprise an extraction pole assembly 16 comprising a plurality of extraction poles 18 and a plurality of couplers 20 coupling adjacent extraction poles 18 together, and an extraction press assembly 22. In one specific example, the projectile extraction system 10 can be used with the extraction pole assembly shown and described in U.S. patent application Ser. No. 16/739,080, filed Jan. 9, 2020, which is incorporated by reference in its entirety herein. In some examples, the projectile extraction system 10 can further comprise a projectile extractor 24 for engaging the projectile 12.

Each of the extraction poles 18 can be coupled to another extraction pole 18 by a coupler 20 so that the plurality of extraction poles 18 can be joined end to end to form an elongate extraction pole assembly 16. A proximal end of a proximal extraction pole 18 of the extraction pole assembly 16 can be configured to interface with (e.g., apply a force to, couple directly or indirectly to, or any other type of interface) the extraction press assembly 22. In one example, the extraction press assembly 22 can press directly on (i.e., apply a force to) a face of the proximal extraction pole 18, or as will be discussed below, an adapter can be inserted between the extraction press assembly 22 and the proximal extraction pole 18, where the extraction press assembly 22 applies a force indirectly to the proximal extraction pole 18 via the adapter.

In operation, the extraction pole assembly 16 can be inserted into the proximal end 13 of the bore 14 and advanced towards the object (e.g., projectile 12) to be removed. The extraction press assembly 22 can be coupled to the structure (e.g., barrel 15) at the proximal end 13 of the bore 14 of the barrel 15. With the extraction pole assembly 16 in place within the bore 14, the extraction press assembly 22 can be actuated to provide or apply an axial force to the extraction pole assembly 16 to force and displace the object in a direction towards a distal opening where the object can be removed. In the example of the barrel 15 of a weapon as shown in FIG. 1, the object (e.g., projectile 12) can be forced towards a breach (not shown) of the barrel 15.

With reference to FIGS. 2 and 3, and continued reference to FIG. 1, the extraction press assembly 22 can comprise a coupling mount 26, a base plate 28, an axial support structure 30, and a press or extraction press 32. The axial support structure 30 connects the base plate 28 to the coupling mount 26, and adjustably supports the base plate 28 in an axially offset position relative to the coupling mount 26. The press 32 can be supported by the base plate 28, and can be located or positioned between the coupling mount 26 and the base plate 28.

The coupling mount 26 can operate to secure the extraction press assembly 22 to the barrel 15, such that no relative movement between the coupling mount 26 and the barrel 15 is permitted in order to facilitate a complete transfer of force from the press 32 to the extraction pole assembly 16 upon actuation of the press, as discussed in more detail below. In one example, the coupling mount 26 can comprise a clamp 34 that clamps to the barrel 15. The clamp 34 can be any clamp configured for coupling to the barrel 15 and for securing the extraction press assembly 22 to the barrel 15. In the example of FIG. 2, the clamp 34 comprises an inner, cylindrical surface that is complementary to (i.e., sized and configured to interface with, engage and clamp around) an outer, cylindrical surface of the barrel 15. The specific size and configuration of the clamp 34 shown is not intended to be limiting in any way. Indeed, other coupling mounts having other sizes and configurations are contemplated, as will be apparent to those skilled in the art. For example, in some embodiments, the coupling mount can comprise an internal thread complementary to an outer thread of the bored structure (i.e., a structure having a bore) to which it is mounted. Or, in another example, the coupling mount can have features, such as a bolt pattern, complementary to a bolt pattern of the bored structure to which it is mounted.

More specifically, as in the example shown, the clamp 34 can comprise a first clamping block 36 having a semi-cylindrical or cylindrical segment interface and a second clamping block 38 having a semi-cylindrical or cylindrical segment interface. Upon the first and second clamping blocks 36, 38 being brought together and positioned adjacent one another, the respective cylindrical segments of the first and second clamping blocks 36, 38 form a cylindrical passage between the first and second clamping blocks 36, 38 (it is noted that the cylindrical passage is substantially cylindrical due to the gap between the first and second clamping blocks 36, 38). The cylindrical passage can have an inner diameter that complements (i.e., is able to interface with, engage and clamp around) an outer diameter of the proximal end 13 of the barrel 15, such that the barrel 15 can be inserted into the passage formed by the first and second clamping blocks 36, 38 (or the first and second clamping blocks 36, 38 can be fit over or onto the barrel 15 and then brought or positioned together adjacent one another). Fasteners 40 extending between the first and second clamping blocks 36, 38 can be used to bias the first block 36 and the second block 38 towards one another, providing or applying a clamping force on the outer surface of the barrel 15, and securing the extraction press assembly 22 to the barrel 15 via the coupling mount 26.

The axial support structure 30 can comprise one or more axial extensions that adjustably positon and space the base plate 28 apart from the coupling mount 26. The axial support structure 30 can further comprise a first interface for coupling to the coupling mount 26 and a second interface for coupling to the base plate. In other words, the axial support structure 30 facilitates the selective adjustment of the spaced distance between the base plate 28 and the coupling mount 26, and thus facilitates the selective adjustment of the press 32 relative to the bore 14 of the barrel 15. In the example shown, the axial extensions can comprise a plurality of threaded rods 42 that extend between and that adjustably secure to the base plate 28 and the coupling mount 26. The axial support structure 30 can further comprise, as the first interface, one or more fasteners, such as nuts 44*a*, that can secure the axial extensions (e.g., the threaded rods 42) to the base plate 28. Similarly, the axial support structure 30 can further comprise, as the second interface, fasteners, such as nuts 44*b*, which can secure the axial extensions (e.g., the threaded rods 42) to the coupling mount 26. The threaded rods 42 can pass through complementary apertures formed in the base plate 28 and the coupling mount 26. The axial length of the axial support structure 30 and the offset distance between the base plate 28 and the coupling mount 26 can be adjusted in a bi-directional manner. In the example shown, this can be accomplished by rotating the nuts 44*a*, 44*b* relative to the threaded rods 42. For example, when one or more of the nuts 44*a*, 44*b* is advanced in a first rotational direction (e.g., clockwise direction) on a respective one of the threaded rods 42, the base plate 28 can be caused to displace relative to the coupling mount 26 in a direction that brings the base plate 28 (and the press 32 as coupled to the base plate 28) towards the coupling mount 26, thus shortening the axial support structure 30. Rotation of one or more of the nuts 44*a*, 44*b* in a second rotational direction (e.g., counter-clockwise direction) can cause the base plate 28 (and the press 32) to displace away from the coupling mount 26, thus lengthening the axial support structure 30.

As indicated, the press 32 can be mounted or otherwise secured to and supported by the base plate 28, and can be located between the coupling mount 26 and the base plate 28. The press 32 can be configured to expand and contract axially to exert or apply a pressing force to the extraction pole assembly 16, and also to remove the pressing force, respectively. In some examples, the press 32 can comprise a scissor-type press comprising a press interface 46 having a press surface 47 (e.g., the structural component of the press 32 that directly (e.g., no load cell present) or indirectly (through a load cell present and supported about the press surface 47, such that an extraction pole of the extraction pole assembly directly interfaces with and contacts the load cell) transfers a force from the press 32 to the extraction pole assembly 16, and that applies a force to the extraction pole assembly 16), a press base 48, first and second proximal linkage arms 50*a*, 50*b*, first and second distal linkage arms 51*a*, 51*b*, an actuator 52, and first and second actuator links 53*a*, 53*b*. Together, the linkage arms 50*a*, 50*b*, 51*a*, 51*b*, and the actuator links 53*a*, 53*b*, operate to couple the press base 48 to the press interface 46. The actuator 52 is operable to manipulate the actuator links 53*a*, 53*b* to bi-directionally displace the press interface 46 relative to the press base 48 and the base plate 28. In some examples, one or more components of the press 32 can be rotatably coupled to the base plate 28 to facilitate positioning or repositioning of the press 32 relative to the base plate 28 and the bore 14 of the barrel 15 (e.g., away from the bore 14 of the barrel 15, in a direction laterally relative to a longitudinal axis of the bore). As in the example shown, which is not intended to be limiting in any way, one or more of the pins connecting the first and second proximal linkage arms 50*a*, 50*b*, the first and second distal linkage arms 51*a*, 51*b*, and/or the first and second actuator links 53*a*, 53*b* can be removed, thus at least partially breaking down the press 32 and allowing various components of the press 32 to be moved to a position away from the bore 14 of the barrel 15. In addition, the press 32 can comprise, and the press base 48 can be rotatably coupled to the base plate 28 via, a press mount 64 securely fixed to the base plate 28, and a pin 57, such that the all of the components of the press 32 that are directly or indirectly supported by the press base 48 can be rotated relative to the base plate 28 by rotating the press base 48 relative to the base plate 28. These concepts are described in greater detail below.

In the example of FIG. 3, rotary connectors rotatably couple each of the linkage arms 50*a*, 50*b*, 51*a*, 51*b* and the actuator links 53*a*, 53*b* to one another, in the order or configuration as shown. The rotary connectors can comprise any connector that allows for a rotating degree of freedom while limiting translational degrees of freedom. In the example of FIG. 3, the rotary connectors comprise cylindrical pins 54. Thus, at least one link or linkage can rotate relative to a connected other link or linkage about a pin 54. Pins 54 can couple a proximal end of each proximal linkage arm 50*a*, 50*b* to the press base 48 and a distal end of each proximal linkage arm 50*a*, 50*b* to a respective actuator link 53*a*, 53*b*. Pins 54 can further couple a proximal end of each distal linkage arms 51*a*, 51*b* to the respective actuator links 53*a*, 53*b*. The first proximal linkage arm 50*a*, the first actuator link 53*a*, and the first distal linkage arm 51*a* can be arranged to mirror the second proximal linkage arm 50*b*, the second actuator link 53*b*, and the second distal linkage arm 51*b*.

The actuator 52 connects the first and second actuator links 53*a*, 53*b* and is operable to change the distance between the actuator links 53*a*, 53*b*. In some examples, the actuator 52 can comprise a threaded rod 55 having a first threaded portion and a second threaded portion. The first threaded portion can have a thread direction opposite a thread direction of the second threaded portion. The first and second actuator links 53*a*, 53*b* can have corresponding threaded apertures for receiving the first and second threaded portions. The actuator 52 can further comprise a handle 29 coupled to and operable to rotate the threaded rod 55. Thus, upon actuation of the actuator 52, such as when the threaded rod 55 is rotated within the first and second actuator links 53*a*, 53*b*, the interaction of the threads of the threaded rod 55 and the threaded apertures of the first and second actuator links 53*a*, 53*b* force the first and second actuator links 53*a*, 53*b* to move either closer together or farther apart depending on the direction of rotation of the threaded rod 55. With the press base 48 seated against the base plate 28 and unable to move, and with the first and second proximal linkage arms 50*a*, 50*b* rotatably coupled to the press base 48 and the first and second actuator links 53*a*, 53*b*, and with the first and second distal linkage arms 51*a*, 51*b* also rotatably coupled to the press base 28 and the first and second actuator links 53*a*, 53*b*, actuation of the actuator 52 operates to rotate the various links and linkages relative to one another, and to bi-directionally and linearly displace the press interface 46 relative to the base plate 28 and the coupling mount 26. It is noted that the specific linkage configuration shown is not intended to be limiting in any way. Indeed, those skilled in the art will recognize that other linkage configurations can be used to bi-directionally displace the press interface 46. This can be in a linear, a non-linear manner, or a combination of these, depending upon the configuration of the linkages. Moreover, the press 32 can comprise other actuator types other than a linkage system. For example, the press 32 can comprise a hydraulic ram operable to hydraulically displace the press interface 46. In still another example, the press 32 can comprise a pneumatic ram operable to pneumatically displace the press interface 46. In still another example, an electric motor can be used to displace the press interface 46.

Figure 4:
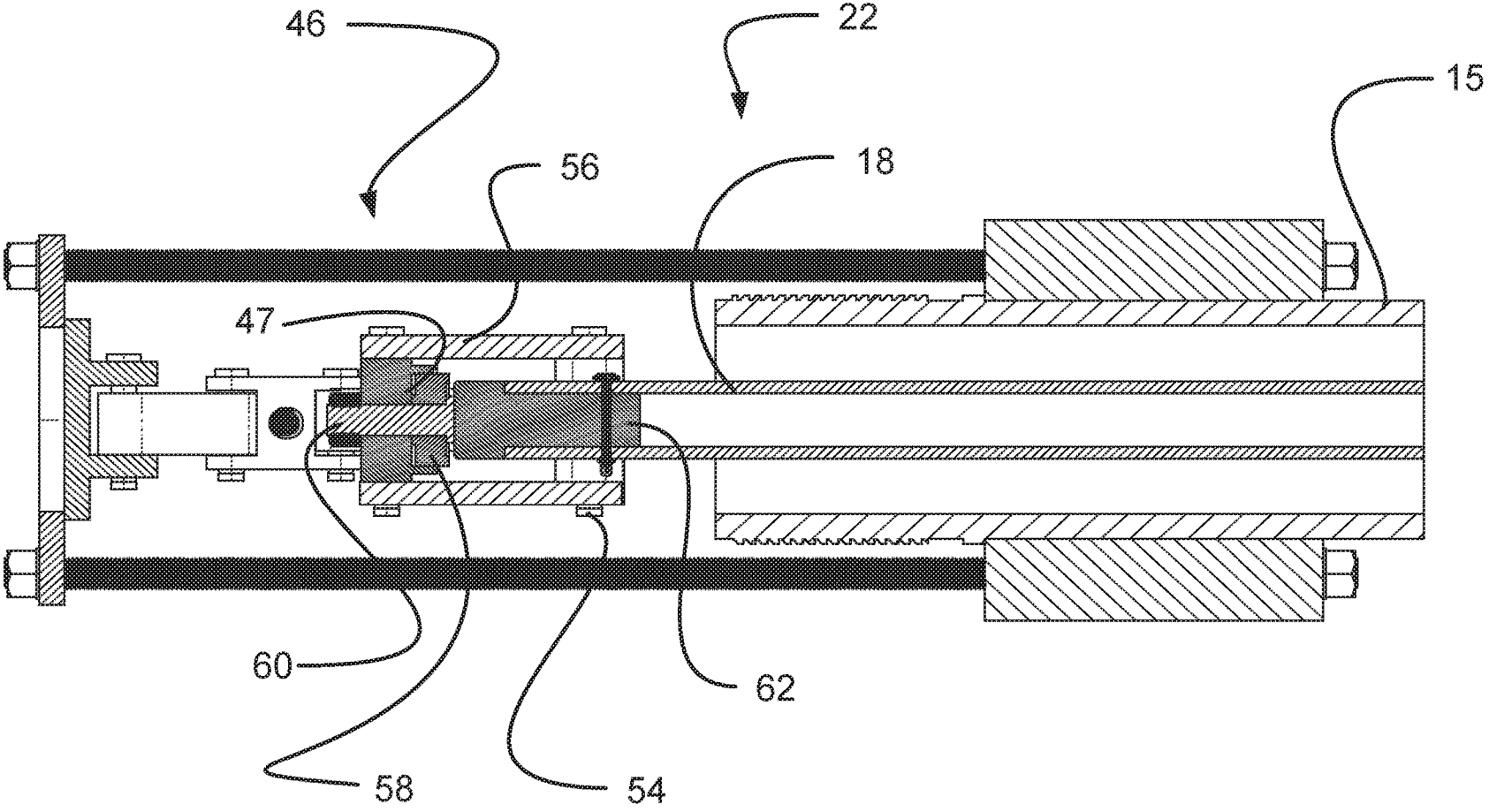
FIG. 4 illustrates a cross-sectional view of the extraction press assembly of the projectile extraction system of FIG. 1, taken along lines A-A of FIG. 3.

FIG. 4 illustrates a cross-section of the extraction press assembly 22, taken about line A-A in FIG. 3. With reference to FIGS. 1-4, the press interface 46 can comprise press surface 47 defined by a plunger or other structure configured to transfer a force from the press 32 to an extraction pole of the extraction pole assembly 16 (which in the example shown is a base portion of a load cell cradle 56), a load cell cradle 56, a load cell 58, and a load cell fastener 60. The load cell cradle 56 can be coupled to the first and second distal linkage arms 51*a*, 51*b* by way of pins 54 and the load cell cradle 56 can be configured to house the load cell 58. The load cell cradle 56 can comprise a base portion that defines a press surface 47 that transmits a force from the press 32 to the extraction pole assembly 16 (directly or indirectly, depending upon the presence and positon of the load cell 58). The load cell 58 can be fastened to the load cell cradle 56 by way of the load cell fastener 60. The load cell fastener 60 can comprise a mounting bolt passing through the load cell cradle 56, which can be secured and loaded using a nut. The load cell 58 can comprise a variety of load cell sensors, and can be supported in a position so as to be operable to measure a force exerted by the press surface 47 on an extraction pole 18 of the extraction pole assembly 16.

An extraction pole adapter 62 can be coupled to the proximal end of an extraction pole 18 of the extraction pole assembly 16. The extraction pole adapter 62 can have a first end sized and shaped to interface with the load cell 58 (thus indirectly with the press surface 47), and a second end opposing the first end, and which is sized and shaped to interface with the extraction pole 18. In some examples, the first end of the extraction pole adapter 62 can comprise a flat surface configured to interface with a flat surface of the load cell 58. In some examples, the second end of the extraction pole adapter 62 can comprise a reduced diameter portion having an external diameter sized to fit within the interior bore of the extraction pole 18, and to complement an inner diameter of the extraction pole 18. A ledge or shoulder can be formed between a head of the extraction pole adapter 62 and the reduced diameter portion, wherein the ledge or shoulder can interface with and be seated against an end edge of the extraction pole 18 to transmit a force from the load cell 58 to the extraction pole 18.

Figure 5:
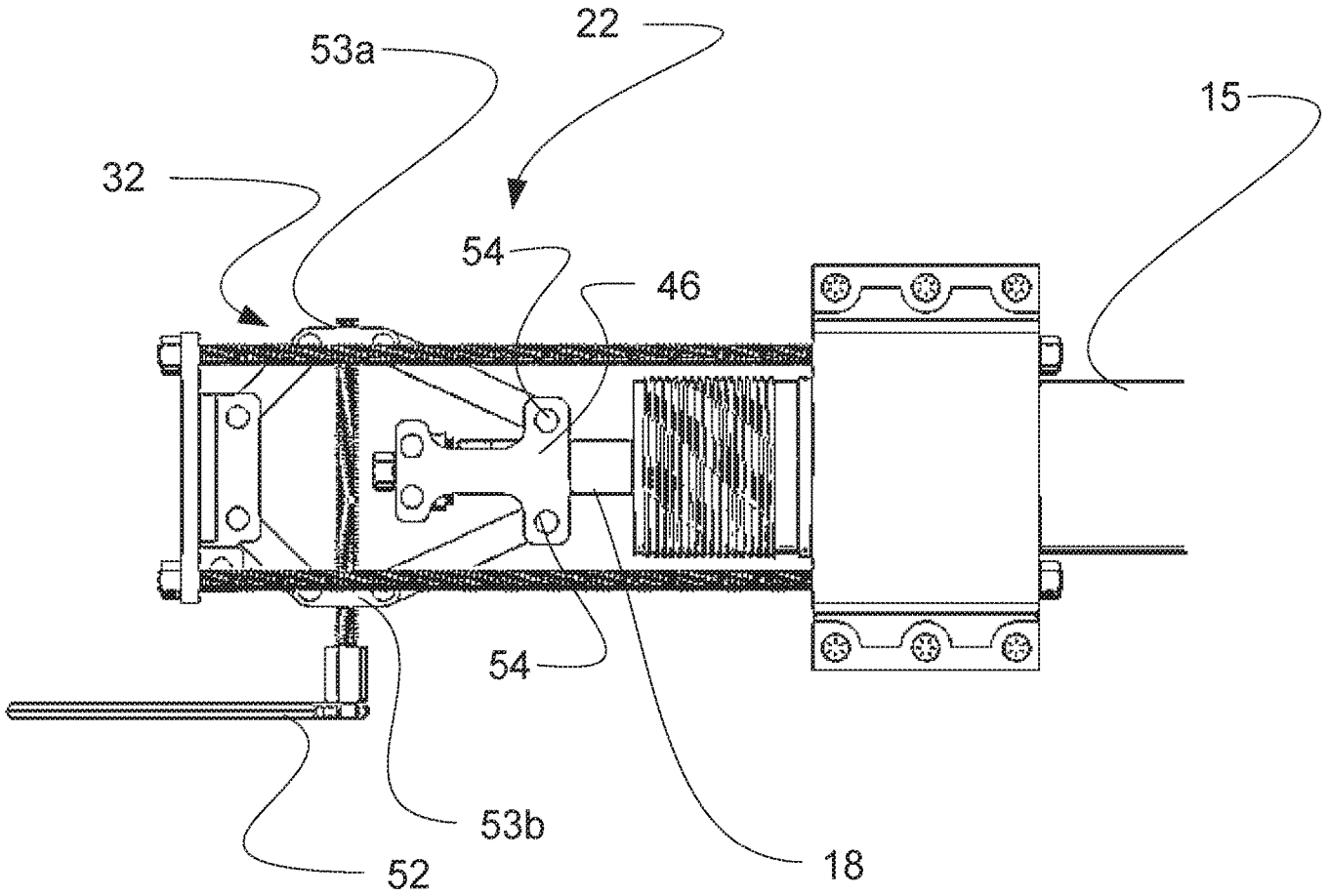
FIG. 5 illustrates a top view of the extraction press assembly of the projectile extraction system of FIG. 1 in an extended configuration.

FIG. 5 illustrates the extraction press assembly 22 with the press 32 in a retracted configuration or position. With reference to FIGS. 1-5, and with the press 32 in the retracted position, the first and second actuator links 53*a*, 53*b* are spaced farther apart from one another, and in which the press interface 46 is either out of contact with the extraction pole assembly 16 (or the extraction pole adapter 62), or in contact with the extraction pole assembly 16 (or the extraction pole adapter 62), but not applying a force to the extraction pole assembly 16 (or extraction pole adapter 62). With the press 32 in the retracted position, a user can carry out macro adjustments with the axial support structure 30 to adjust the position of the press 32 so that the press interface 46, and particularly the press surface 47 (or a load cell 58 supported about the press surface 47), is positioned adjacent the extraction pole 18 of the extraction pole assembly 16. For instance, a user may adjust the nuts 44*a*, 44*b* on the threaded rods 42 to move the base plate 28 and the press 32, and particularly the press interface 46 and press surface 47, towards the barrel 15 and the extraction pole 18. By adjusting the press 32 in its retracted position so that the press surface 47 (or the surface of a load cell 58 supported about the press surface 47) of the press interface 46 is positioned adjacent the extraction pole 18, the full stroke of the press 32 can be more fully utilized upon actuation to apply a force to the extraction pole 18.

Figure 6:
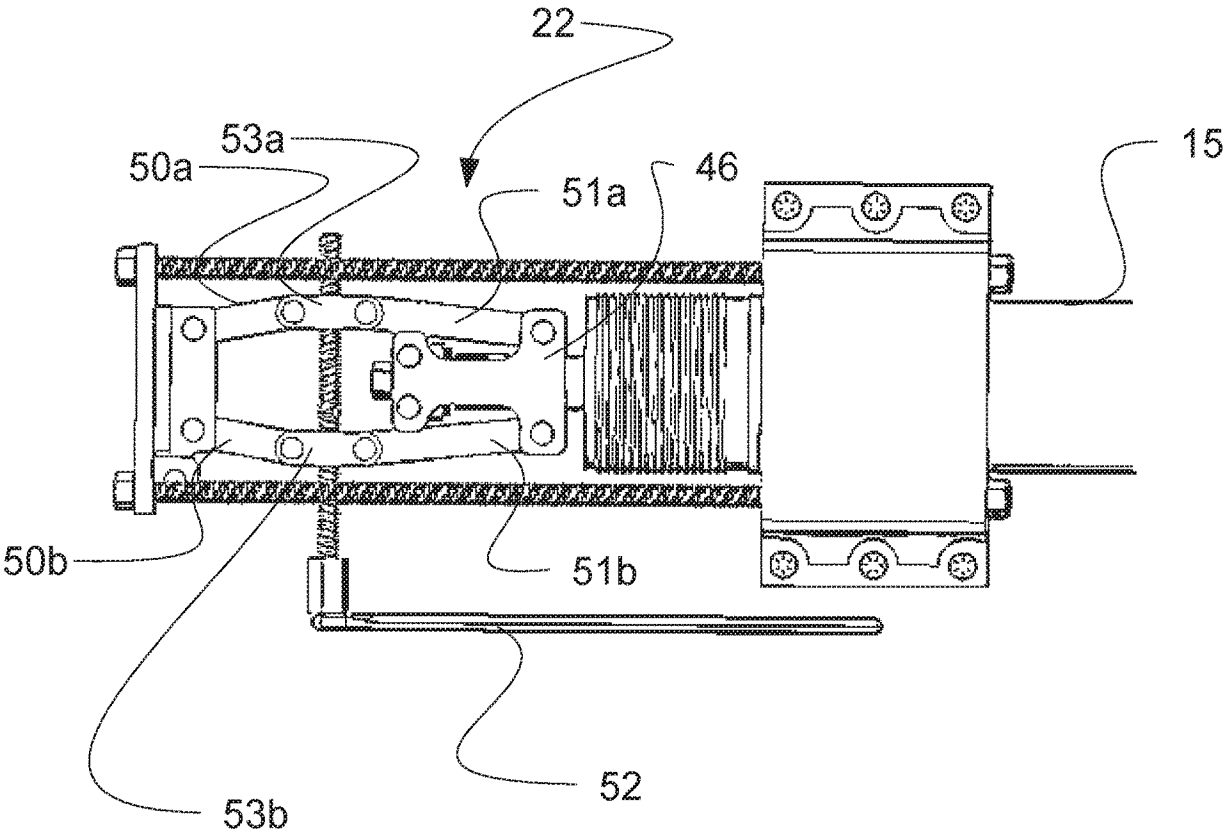
FIG. 6 illustrates a top view of the extraction press assembly of the projectile extraction system of FIG. 1 in a retracted configuration.

FIG. 6 illustrates the extraction press assembly 22 with the press 32 in an extended position as facilitated by actuation of the actuator 52, wherein the first and second actuator links 53*a*, 53*b* are positioned closer to one another than the relative position of these as shown in FIG. 5. With reference to FIGS. 1-6, the press 32 can be actuated to go from the retracted position of FIG. 5 to the extended position of FIG. 6 through the actuation of the actuator 52, which in the case of the threaded rod 55, moves the first and second actuator links 53*a*, 53*b* as a result of the turning of the threaded rod 55. As the actuator 52 is actuated in a manner so as to bring the first actuator link 53*a* and the second actuator link 53*b* towards one another, the linkage arms 50*a*, 50*b*, 51*a*, 51*b* rotate from the retracted position shown in FIG. 5 to the extended position shown in FIG. 6. The rotation of the linkage arms 50*a*, 50*b*, 51*a*, 51*b* from the retracted position to the extended position increases the overall length of the press 32, thus displacing the press interface 46 towards the barrel 15, wherein the press surface 47 (or the load cell 58, if present and positioned to do so) is caused to contact (if not already in contact) and displace the proximal extraction pole 18 into the bore 14 in a direction away from the extraction press assembly 22 and towards a distal end of the barrel 15. Actuation of the press 32 operates to displace the extraction pole assembly 16, which acts on the projectile 12 to displace the projectile 12.

In one example, the difference in length of the press 32 between the position shown in FIG. 5 and the position shown in FIG. 6 (i.e., the stroke length) can be about two inches, which of course, is not intended to be limiting in any way, and which length can be any length needed or desired by designing the components of the press 32 to achieve this. In one example, the stroke length can be altered by changing the length of the proximal and distal linkage arms 50*a*, 50*b*, 51*a*, 51*b*. The mechanical advantage of the press 32 can be adjusted by altering the pitch of the threads of the threaded rod 55, or by altering the distance between connection points of the press base 48 and the proximal and distal linkage arms 50*a*, 50*b*, 51*a*, 51*b* (thus altering the angle of these relative to one another). The stroke length can be selected to be sufficient to loosen the projectile 12 from the bore 14 (e.g. two inches). Once the projectile 12 has been loosened in the bore 14, if it does not fall out on its own, it may be manually pushed by hand using the extraction pole assembly 16.

Once the projectile 12 has been successfully dislodged, the press interface 46 can be retracted. For example, the actuator in the form of the threaded rod 55 can be rotated in a direction opposite a direction that caused the press 32 to extend, wherein the first and second actuator links 53*a*, 53*b* move laterally outward away from one another, thus reducing the overall length of the press 32.

In some examples, the press 32 can be configured to break away, at least in part, from the base plate 28 to provide a user with relatively more unobstructed access to the bore 14 at the proximal end of the barrel 15. For example, it may be necessary for a user to manually press the extraction pole assembly 16 further into the bore 14 once the press 32 has been extended its full length. Breaking down the press 32 enables the user to access the bore 14 without having to entirely decouple and remove the extraction press assembly 22 from the barrel 15. With reference to FIGS. 1-7, first step in a process of breaking down the press 32 can involve decoupling one or more of the distal linkage arms 51*a*, 51*b* from the press interface 46. In the example shown in FIG. 7, the extraction press assembly 22 is shown as having a pin 54 coupling the first distal link arm 51*a* to the press interface 46 removed, thus decoupling these, and thus facilitating the press interface 46 to rotate away from and relative to the second distal link arm 51*a*. Additionally, without the pin 54 coupling the first distal link arm 51*a* to the press interface 46, the second distal link arm 51*b* is able to rotate relative to the second actuator link 53*b*, and the second actuator link 53*b* is able to rotate relative to the second proximal link arm 50*b*, which is able to rotate relative to the press base 48. With the pin 54 removed, the press interface 46 can be caused to rotate away from the bore 14, and the second distal link arm 51*b* can be caused to rotate away from the bore 14 as well.

Figure 7:
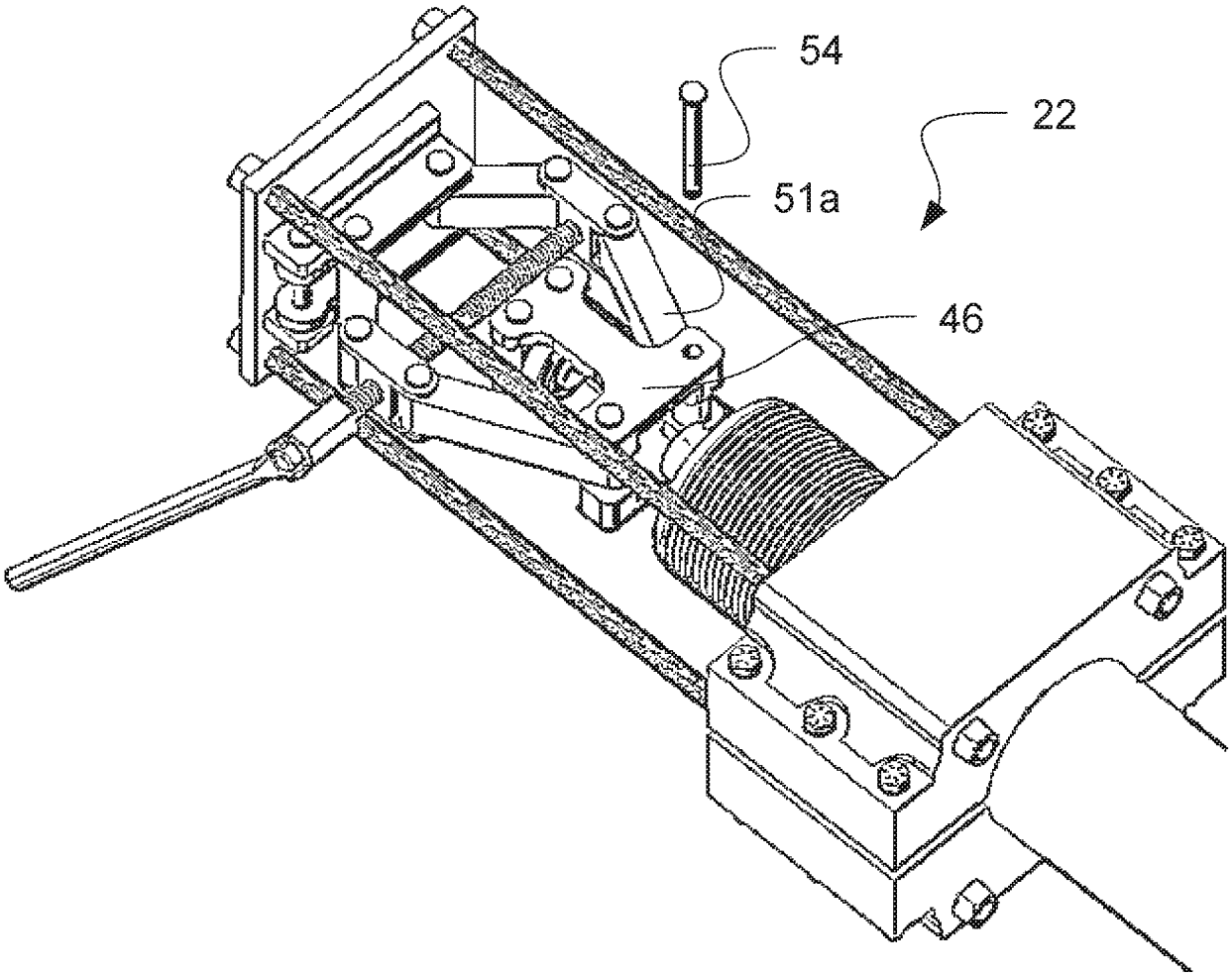
FIG. 7 illustrates an isometric view of the extraction press assembly of the projectile extraction system of FIG. 1 with a retaining pin removed to facilitate at least a partial breaking down of the press of the extraction press assembly.
Figure 8:
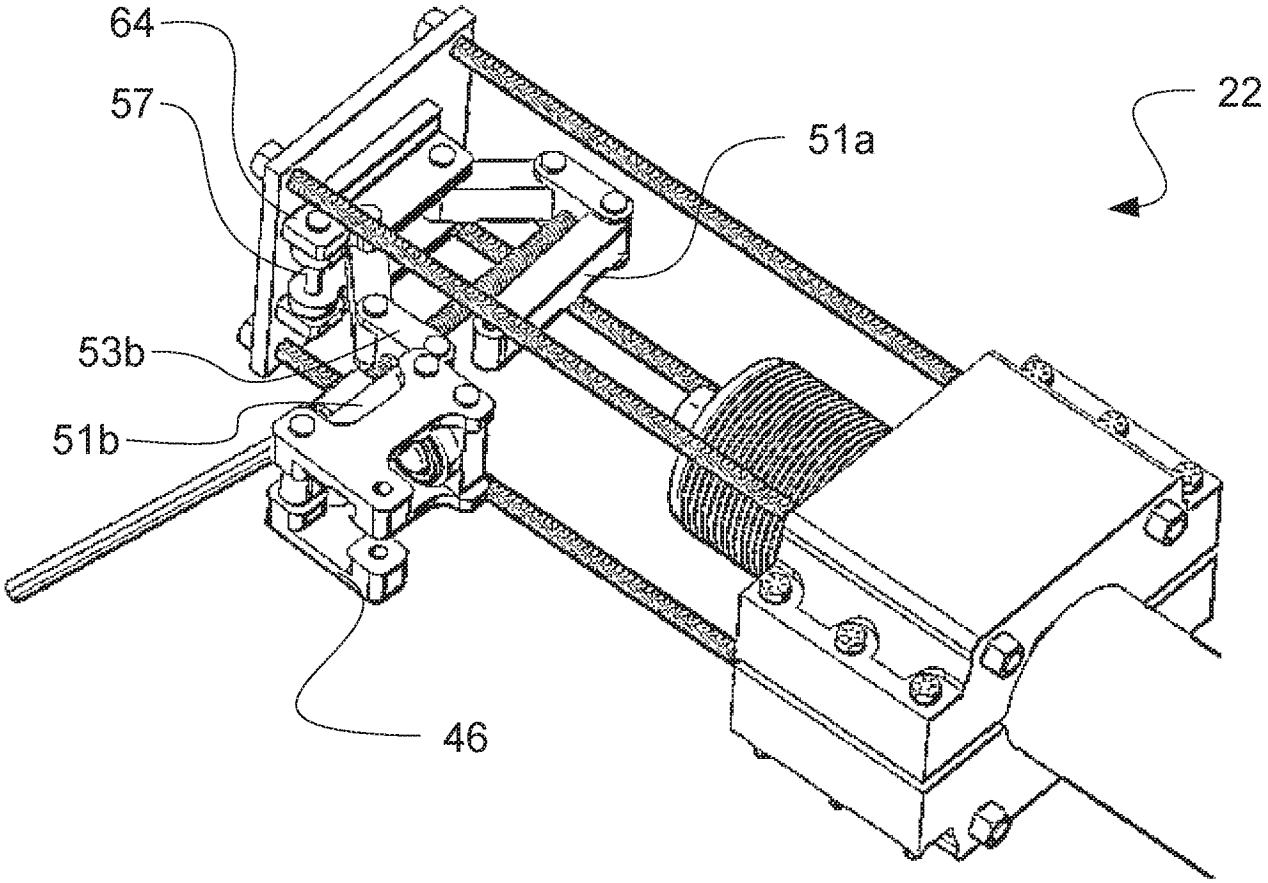
FIG. 8 illustrates an isometric view of the extraction press assembly of the projectile extraction system of FIG. 1 with a press interface of the extraction press assembly repositioned relative to the base plate and the barrel.

FIG. 8 illustrates the extraction press assembly 22 at least partially broken down, with the press interface 46 and the second distal link arm 51*b* rotated to move and position the press interface 46 laterally away from the bore 14. Indeed, and with reference to FIGS. 1-8, the press interface 46 can be moved or repositioned to any position permitted by the relative rotation of the press interface 46, the second distal link arm 51*b*, the second actuator link 53*b*, and the second proximal link arm 50*b* (which rotates relative to the press base 48). In some cases, the press interface 46 can be rotated to a position beyond or laterally outside of the axial support structure 30 (in this case the thread rods 42). Moreover, the first distal link arm 51*a*, the first actuator link 53*a*, the first proximal link arm 50*a* (which rotates relative to the press base 48), can also be moved or positioned to any position permitted by the relative rotation of these components, such as to a collapsed position about the press base 48, or extended laterally beyond the thread rods 42. In any event, removing one or more of the pins coupling the press interface 46 to the link arms 51*a*, 51*b* can facilitate the at least partial breaking down of the extraction press assembly 22 to position or reposition the components of the extraction press assembly 22 away from and out of the way of the bore 14 of the barrel 15, thus providing greater clearance between the components making up the press 32 and the proximal end of the barrel 15 than is available with the press 32 not broken down and all the links and linkages coupled. This increased clearance facilitates easier, less obstructed access to the bore 14 of the barrel 15. Advantageously, the bore 14 may be accessed with the extraction press assembly 22 still mounted or coupled to the barrel 15.

With reference to FIGS. 1-9, the extraction press assembly 22, and particularly the press 32, can still be further positioned or repositioned away from the barrel 15, such as in the event additional access to the bore 14 is needed or desired. For example, the press base 48 (and the remaining components of the press 32 directly or indirectly coupled to or supported by the press base 48) can be rotated relative to the base plate 28 via the press mount 64 securely fixed to the base plate 28 and coupled to the press base 48 via the pin 57. The press mount 64 can comprise tabs (in this example, first and second tabs) extending perpendicularly from the base plate 28, with each tab having an aperture sized to receive the pin 57. The pin 57 can be inserted through the aperture of the tabs and through a corresponding mount aperture of the press base 48. The press base 48 is then operable to be rotated about the pin 57 securing the press base 48 to the base plate 28. Thus, the press mount 64 facilitates rotation of the press base 48 relative to the base plate 28 about pin 57 from the position shown in FIGS. 1-8 to the position shown in FIG. 9. Indeed, the rotatably coupling of the press base 48 to the press mount 64 operates to form a hinge joint between the base plate 28 and the press 32.

Figure 9:
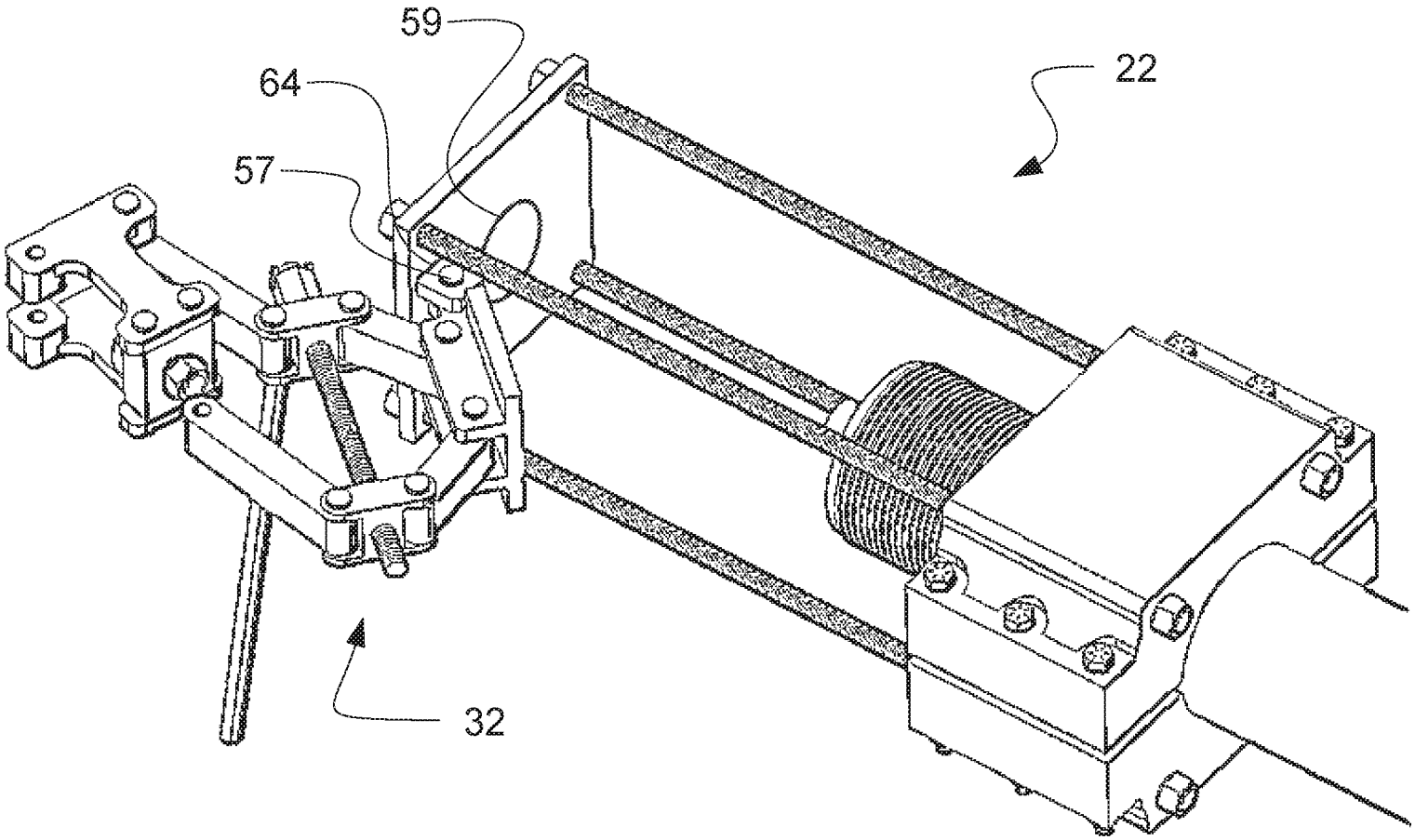
FIG. 9 illustrates an isometric view of the extraction press assembly of the projectile extraction system of FIG. 1 with the extraction press positioned in a second rotation position relative to the base plate.

The press base 48 can be constrained from translational movement relative to the base plate 28, but can be free to rotate about the base plate 28 as it is rotatably coupled to the base plate 28 via the press mount 64 and the pin 57. Rotation of the press 32 (including the press base 48 and any links or link arms directly or indirectly coupled thereto and supported thereby) about the axis of rotation provided by the press mount 64 and the pin 57, facilitates rotation of the press 32 (including the press base 48 and any links or link arms directly or indirectly coupled thereto and supported thereby) relative to or about the base plate 28, as shown in FIG. 9. It is noted that the rotation of the press 32 relative to the base plate 28 can be achieved with the press fully assembled (i.e., not broken down) and all of the pins 54 in place (i.e., without any removed, such as is shown in FIG. 7). As shown in FIG. 9, almost the entire press 32 (all but the press base 48 and the press mount 64) can be rotated laterally to be outside of the axial support structure 30 (the thread rods 42), thus providing even greater clearance between the proximal end of the barrel 15 and the base plate 28 of the extraction press assembly 22. For example, with the press 32 in the orientation and position shown in FIG. 9, the bore 14 of the barrel 15 can be accessed with little difficulty.

The base plate 28 can further comprise an aperture 59. In one example, the aperture 59 (or a central axis of the aperture 59) can be axially aligned (coaxial) with the central longitudinal axis of the clamp 34 of the extraction press assembly 22, and the bore 14 of the barrel 15. The aperture 59 in the base plate 28 can sized and configured to receive therethrough the extraction pole assembly 16. Indeed, the extraction pole assembly 16 can be inserted and removed through the aperture 59 in the base plate 28 to facilitate insertion and removal from the bore 14 of the barrel 15. As such, the extraction pole assembly 16 can be inserted into and removed from the barrel 15 without having to remove or decouple the extraction press assembly 22 from the barrel 15. Stated differently, the extraction pole assembly 16 can be inserted into or removed from the bore 14 with the extraction press assembly 22 remaining coupled or mounted to the barrel 15 via the clamp 34.

The projectile extraction system described in the preceding examples can be used to extract a projectile from a bore of a weapon by applying an axial force to the projectile. Again, this is not intended to be limiting in any way as the extraction system can comprise different types of extraction systems (other than a projectile extraction system) operable to extract different types of objects from a bored structure (other than projectiles from weapons). Referring to the previous figures, the present disclosure sets forth a method for removing an object from a bored structure, which method can comprise assembling various extraction poles 18 to provide an extraction pole assembly 16, inserting the extraction pole assembly 16 into the bore 14, coupling an extraction press assembly 22 to a structure having the bore 14, moving a press 32 of the extraction press assembly 22 to position a press surface 47 near the extraction pole assembly 16, actuating the press 32 to apply a force to the extraction pole assembly 16, and rotating the press surface 47 away from the bore 14 to provide access to the extraction pole assembly 16.

In some examples, the method can further include coupling the extraction poles 18 end to end. For example, a centering coupler can be used to couple a distal end of a first extraction pole 18 to a proximal end of a second extraction pole 18. In some examples, the extraction poles 18 can be coupled together directly.

The extraction pole assembly 16 can be inserted into the bore 14 with the extraction press assembly 22 coupled to the structure having the bore (e.g., the bore 14 of the barrel 15) or it can be inserted prior to coupling the extraction press assembly 22 to the structure. For example, the press 32 can be rotated to the configuration shown in FIG. 9 to expose a central aperture 59 of the base plate 28. Thus, the extraction pole assembly 16 can be inserted through the central aperture 59 and into the bore 14. The press 32 can then be rotated back into the configuration shown in FIG. 5 where it can be actuated as described herein.

The extraction press assembly 22 can be coupled to the structure having the bore 14 using the coupling mount 26. For example, the first block 36 and the second block 38 of the clamp 34 can each be positioned on either side of a distal end of the barrel 15. Then the fasteners 40 can be used to tighten the blocks 36, 38 together around the barrel 15, coupling the extraction press assembly 22 to the barrel 15. In other examples, the coupling mount 26 can have a single threaded bore to complement a thread of the barrel 15 and the coupling mount 26 can be threaded onto the barrel 15, or the coupling mount 26 can have a bolt pattern complementing a bolt pattern of the barrel 15 and the coupling mount 26 can be bolted to the barrel 15.

The press 32 can be moved to position the press surface 47 near the extraction pole assembly 16 by adjusting the axial extensions of the axial support structure 30. For example, nuts 44*a*, 44*b* can be tightened on the thread rods 42 to move the base plate 28 towards the coupling mount 26 which in turn moves the press 32 and the press surface 47 towards the extraction pole assembly 16.

The press 32 can be actuated using actuator 52 to expand the press axially to move the press surface 47 and provide an axial force to the extraction pole assembly 16. For example, a user can rotate the threaded rod 55 using the handle 29. The interaction of the threads of the threaded rod 55 and the threads of the actuator links 55*a*, 55*b* pulls the actuator links 55*a*, 55*b* towards one another, extending the first and second proximal linkage arms 50*a*, 50*b* and the first and second distal link arms 51*a*, 51*b*. As the linkage arms 50*am* 50*b*, 51*a*, 51*b* extend, the press surface 47 is advanced towards the extraction pole assembly 16 until it contacts the extraction pole assembly 16. Further actuation of the press 32 by further rotation of the threaded rod 55 by the handle 29 in the same direction functions to apply a force to the extraction pole assembly 16. The force required to remove the object can be measured (and in some examples also recorded) using the load cell 58 situated between the press surface 47 and the extraction pole assembly 16.

The press surface 47 can be rotated away from the bore 14 to provide access to the extraction pole assembly 16 by removing pin 54, as shown in FIG. 7 and rotating the second distal link arm 51*b* and the press interface 46 as shown in FIG. 8 and/or by rotating the entire press 32 away from the base plate 28 as shown in FIG. 9.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. An extraction press assembly for facilitating removal of an object from a bore of a structure, the extraction press assembly comprising:

a coupling mount configured to couple to a structure having a bore;

a base plate axially spaced from the coupling mount;

a support structure having axial extensions operable to couple the coupling mount to the base plate; and a press supported between the coupling mount and the base plate, the press configured to expand and contract axially to exert a pressing force on an extraction pole within the bore; and wherein the press is pivotally secured to the base plate, such that the press is rotatable between a first position that axially aligns the press interface with the axis of the bore to facilitate extracting of an object from the bore, and a second position that positions the press interface out of axial alignment with the axis of the bore to facilitate access to the bore.

2. The extraction press assembly of claim 1, wherein the press comprises:

a press base;

first and second proximal link arms rotatably coupled to the press base;

first and second actuator links rotatably coupled to the first and second proximal link arms;

first and second distal link arms rotatably coupled to the first and second actuator links;

a press interface rotatably coupled to the first and second distal link arms; and an actuator coupling the first and second actuator links, and operable to actuate the press to position the press interface between a retracted position and an extended position.

3. The extraction press assembly of claim 2, wherein the first and second actuator links each comprise a threaded aperture and the actuator comprises a rod having a thread threaded in each threaded aperture of the first and second actuator links, wherein a thread of the threaded aperture of the first actuator link has a thread direction opposite of a thread of the threaded aperture of the second actuator link.

4. The extraction press assembly of claim 2, wherein the press interface comprises a cradle defining a press surface located between the first and second distal link arms.

5. The extraction press assembly of claim 4, wherein the press further comprises a load cell supported by the cradle about the press surface.

6. The extraction press assembly of claim 2, wherein the press base is pivotally coupled to the base plate.

7. The extraction press assembly of claim 2, wherein the press interface is pivotally coupled to at least one of the first or second distal link arms by one or more removable pins, such that removal of any one of the one or more removable pins facilitates at least partial separation of the press interface from the first or second distal link arms.

8. The extraction press assembly of claim 1, wherein the base plate comprises a central aperture extending through the base plate.

9. The extraction press assembly of claim 1, wherein the axial extensions facilitate selective adjustment of the coupling mount relative to the base plate.

10. An extraction system for facilitating removal of an object from a bore of a structure, the extraction system comprising:

an extraction press assembly comprising:

a coupling mount configured to couple to the structure;

a base plate axially spaced from the coupling mount, and supporting a press mount;

a support structure having axial extensions coupling the coupling mount to the base plate; and a press supported between the coupling mount and the base plate, the press having a press base rotatably coupled to a press mount to pivotally mount the press to the base plate; and an extraction pole assembly comprising a plurality of extraction poles, wherein the extraction pole assembly is configured to receive an axial force from the press of the extraction press assembly.

11. The extraction system of claim 10, wherein the base plate comprises a plurality of apertures, the coupling mount comprises a plurality of complementary apertures, and the axial extensions comprise a plurality of threaded rods, each threaded rod extending through an aperture of the base plate and a complementary aperture of the coupling mount.

12. The extraction system of claim 10, wherein the press mount comprises a plurality of tabs having an aperture and the press base comprises a mount aperture, wherein the apertures of the tabs and the mount aperture of the press base are sized to receive a pin to form a hinge joint between the base plate and the press.

13. The extraction system of claim 10, wherein the extraction press assembly further comprises an adapter positioned between the extraction press assembly and a proximal extraction pole of the extraction pole assembly, where the extraction press assembly operates to apply a force indirectly to the proximal extraction pole via the adapter.

14. The extraction system of claim 10, wherein the extraction press assembly further comprises a load cell supported by a cradle about a press surface of the press, wherein the load cell is operable to measure the axial force applied by the press to the extraction pole assembly.

15. A method for removing an object from a bore of a structure, the method comprising:

inserting an extraction pole assembly into the bore of the structure until the extraction pole assembly contacts the object to be removed from the bore;

coupling an extraction press assembly to the structure at an opening of the bore;

moving a press of the extraction press assembly to position a press surface near the extraction pole assembly;

actuating the press to apply a force to the extraction pole assembly to dislodge the object; and rotating the press surface away from the bore to provide access to the extraction pole assembly.

16. The method of claim 15, further comprising actuating the press to reposition the press surface away from the extraction pole assembly.

17. The method of claim 15, further comprising assembling the extraction pole assembly by coupling a plurality of extraction poles end to end.

18. The method of claim 15, wherein moving the press comprises adjusting an axial support structure connecting the coupling mount to the base plate.

19. The method of claim 15, further comprising measuring the force applied to the extraction pole assembly.

20. The method of claim 15, wherein measuring the force is facilitated by placing a load cell between the press surface and the extraction pole assembly.

21. The method claim 15, wherein the structure comprises a barrel of a weapon, and the object to be removed comprises a projectile.

* * * * *